US006172272B1

(12) United States Patent
Shabtai et al.

(10) Patent No.: US 6,172,272 B1
(45) Date of Patent: Jan. 9, 2001

(54) PROCESS FOR CONVERSION OF LIGNIN TO REFORMULATED, PARTIALLY OXYGENATED GASOLINE

(75) Inventors: Joseph S. Shabtai; Wlodzimierz W. Zmierczak, both of Salt Lake City, UT (US); Esteban Chornet, Golden, CO (US)

(73) Assignee: The University of Utah, Salt Lake City, UT (US)

( * ) Notice: Under 35 U.S.C. 154(b), the term of this patent shall be extended for 0 days.

(21) Appl. No.: 09/376,864

(22) Filed: Aug. 18, 1999

Related U.S. Application Data

(60) Provisional application No. 60/097,701, filed on Aug. 21, 1998.

(51) Int. Cl.[7] ..... C10G 1/00; C07C 1/00

(52) U.S. Cl. ..... 585/242; 585/240; 585/469; 585/638; 585/639; 568/630; 44/447; 44/450; 208/68; 208/108

(58) Field of Search ..... 585/242, 240, 585/469, 638, 639; 208/68, 108; 44/447, 450; 568/630

(56) References Cited

U.S. PATENT DOCUMENTS

| | | | |
|---|---|---|---|
| H1305 | 5/1994 | Townsend et al. | 44/449 |
| 4,244,704 | 1/1981 | Sweeney et al. | 44/78 |
| 4,267,317 | 5/1981 | Koike et al. | 542/416 |
| 4,295,860 | 10/1981 | Childs | 44/63 |
| 4,300,009 | 11/1981 | Haag et al. | 585/408 |
| 4,312,636 | 1/1982 | Singerman | 44/53 |
| 4,353,711 | 10/1982 | Childs | 44/63 |
| 4,487,975 | 12/1984 | Ratton | 568/587 |
| 4,487,976 | 12/1984 | Farcasiu | 568/630 |
| 4,611,084 | 9/1986 | Mossman | 568/630 |

(List continued on next page.)

OTHER PUBLICATIONS

Joseph Snabati; W. Zmierczak; and, Esteban Chornet, "Conversion of Lignin to Reformulated Gasoline Compositions. 1. Basic Processing Scheme," Proc. 3rd Biomass Confer. of the Americas, Montreal, Elsevier, Aug. 1997, vol. 2, pp. 1037–1040.

Joseph Shabtai; N. K. Nag; and, F. E. Massoth, "Catalytic Functionalities of Supported Sulfides. IV. C–O Hydrogenolysis Selectivity as a Function of Promoter Type," Journal of Catalysis 104, 413–423 (1987).

Joseph Shabtai; Que Gouhe; K. Blausami; N. K. Nag; and, F. E. Massoth, "Catalytic Functionalities of Supported Sulfides. V. C–N Bond Hydrogenolysis Selectivity as a Function of Promoter Type," Journal of Catalysis 113, 206–219 (1988).

(List continued on next page.)

*Primary Examiner*—Bekir L. Yildirim
(74) *Attorney, Agent, or Firm*—Workman, Nydegger & Seeley

(57) ABSTRACT

A high-yield process for converting lignin into reformulated, partially oxygenated gasoline compositions of high quality is provided. The process is a two-stage catalytic reaction process that produces a reformulated, partially oxygenated gasoline product with a controlled amount of aromatics. In the first stage of the process, a lignin feed material is subjected to a base-catalyzed depolymerization reaction, followed by a selective hydrocracking reaction which utilizes a superacid catalyst to produce a high oxygen-content depolymerized lignin product mainly composed of alkylated phenols, alkylated alkoxyphenols, and alkylbenzenes. In the second stage of the process, the depolymerized lignin product is subjected to an exhaustive etherification reaction, optionally followed by a partial ring hydrogenation reaction, to produce a reformulated, partially oxygenated/etherified gasoline product, which includes a mixture of substituted phenyl/methyl ethers, cycloalkyl methyl ethers, $C_7$–$C_{10}$ alkylbenzenes, $C_6$–$C_{10}$ branched and multibranched paraffins, and alkylated and polyalkylated cycloalkanes.

26 Claims, 3 Drawing Sheets

U.S. PATENT DOCUMENTS

| | | | |
|---|---|---|---|
| 4,638,098 | 1/1987 | Mossman | 568/630 |
| 4,647,704 | 3/1987 | Engel et al. | 568/716 |
| 4,675,375 | 6/1987 | Kempter et al. | 528/140 |
| 4,675,454 | 6/1987 | Mossman | 568/630 |
| 4,675,455 | 6/1987 | Mossman | 568/630 |
| 4,675,456 | 6/1987 | Mossman | 568/630 |
| 4,678,860 | 7/1987 | Kuester | 585/14 |
| 4,728,418 | 3/1988 | Shabtai et al. | 208/413 |
| 4,762,529 | 8/1988 | Shulz | 44/53 |
| 5,047,332 | 9/1991 | Chahal | 435/42 |
| 5,095,167 | 3/1992 | Christensen | 585/720 |
| 5,120,895 | 6/1992 | Child et al. | 585/721 |
| 5,135,639 | 8/1992 | Schmidt et al. | 208/66 |
| 5,180,868 | 1/1993 | Baker et al. | 585/240 |
| 5,186,722 | 2/1993 | Cantrell et al. | 44/605 |
| 5,191,146 | 3/1993 | Gajda et al. | 585/667 |
| 5,196,626 | 3/1993 | Child et al. | 585/720 |
| 5,198,097 | 3/1993 | Bogdan et al. | 208/79 |
| 5,200,059 | 4/1993 | Bogdan et al. | 208/79 |
| 5,235,120 | 8/1993 | Bogdan et al. | 585/253 |
| 5,242,576 | 9/1993 | Schmidt et al. | 208/78 |
| 5,243,121 | 9/1993 | Madon et al. | 585/649 |
| 5,284,990 | 2/1994 | Peterson et al. | 585/709 |
| 5,288,393 | 2/1994 | Jessup et al. | 208/16 |
| 5,292,984 | 3/1994 | Gajda et al. | 585/667 |
| 5,294,328 | 3/1994 | Schmidt et al. | 208/66 |
| 5,336,831 | 8/1994 | Gajda et al. | 585/667 |
| 5,358,873 | 10/1994 | Nowak | 436/56 |
| 5,365,008 | 11/1994 | Barger et al. | 585/667 |
| 5,366,517 | 11/1994 | Cherpeck | 44/387 |
| 5,367,101 | 11/1994 | Lawson et al. | 585/667 |
| 5,382,350 | 1/1995 | Schmidt | 208/65 |
| 5,401,385 | 3/1995 | Schmidt et al. | 208/57 |
| 5,401,388 | 3/1995 | Schmidt et al. | 208/79 |
| 5,409,507 | 4/1995 | Cherpeck | 44/399 |
| 5,466,872 | 11/1995 | Cherpeck | 564/443 |
| 5,478,366 | 12/1995 | Teo et al. | 44/301 |
| 5,498,810 | 3/1996 | Bogdan et al. | 585/310 |
| 5,504,259 | 4/1996 | Diebold et al. | 568/697 |
| 5,510,559 | 4/1996 | Barger et al. | 585/664 |
| 5,510,561 | 4/1996 | Sherman et al. | 585/734 |
| 5,516,342 | 5/1996 | Cherpeck | 44/347 |
| 5,516,960 | 5/1996 | Robinson | 585/639 |
| 5,536,886 | 7/1996 | Tamminen et al. | 568/697 |
| 5,538,624 | 7/1996 | Hettinger | 208/121 |
| 5,578,090 | 11/1996 | Bradin | 44/308 |
| 5,583,275 | 12/1996 | Kranz et al. | 585/709 |
| 5,593,567 | 1/1997 | Jessup et al. | 208/46 |
| 5,596,196 | 1/1997 | Cooper et al. | 250/339.12 |
| 5,601,797 | 2/1997 | Gentry | 423/659 |
| 5,605,551 | 2/1997 | Scott et al. | 44/307 |
| 5,621,150 | 4/1997 | Rastelli et al. | 568/697 |
| 5,648,586 | 7/1997 | Sampath | 585/716 |
| 5,653,866 | 8/1997 | Jessup et al. | 208/46 |
| 5,677,154 | 10/1997 | Van Draanen et al. | 435/163 |
| 5,684,580 | 11/1997 | Cooper et al. | 356/301 |
| 5,697,987 | 12/1997 | Paul | 44/352 |
| 5,705,722 | 1/1998 | Monnier et al. | 585/240 |
| 5,712,481 | 1/1998 | Welch et al. | 250/339.12 |
| 5,713,965 | 2/1998 | Foglia et al. | 44/388 |
| 5,735,916 | 4/1998 | Lucas et al. | 44/605 |
| 5,752,992 | 5/1998 | Hendriksen | 44/449 |
| 5,959,167 | 9/1999 | Shabtai et al. | 585/242 |

OTHER PUBLICATIONS

Joseph Shabtai and Yuan Zhang, "Low Temperature Coal Deplymerization–Liquefaction. 8. Conversion of a North Dakota Lignite to a Light Hydrocarbon Oil," 1989 International Conference on Coal Science, Proceedings vol. II, Oct. 23–17, 1989, Tokyo, Japan.

Lyle F. Albright, "Alkylation Will Be Key Process in Reformulated Gasoline Era," Oil & Gas Journal, Nov. 12, 1990, pp. 79–92.

Joseph Shabtai; N. K. Nag; and, F. E. Massoth, "Sterochemistry of Hydrogenation of Aromatic Compounds with Sulfided Catalysts. 1. Naphthalene and Quinoline," Proceedings of 9th International Congress on Catalysis, Calgary, Canada 1988, vol. 1, pp. 1–10.

Enrique Iglesia; David G. Barton; Stuart L. Soled; Sabato Miseo; Joseph E. Baumgarter; William E. Gates; Gustavo A. Fuentes; and, George D. Meitzner, "Selective Isomerization of Alkanes on Supported Tungsten Oxide Acids," 11th International Congress on Catalysis—40th Anniverary, Studies in Surface Science and Catalysis, vol. 101, 1996.

F. Garin; D. Andriamasinoro; A. Abdulsamad; and, J. Sommer, "Conversion of Butane Over the Solid Superacid $ZrO_2/SO_4^2$ in the Presence of Hydrogen,"Mar. 1990, pp. 199–203.

K. Tanabe and and T. Yamaguchi, "Design of Sulfur–Promoted Solid Superacid Catalyst," Successful Design of Catalysts, 1988, pp. 99–110.

P. Nascimento; C. Akratopoulou; M. Oszagyan;G. Coudurier; C. Travers; J.F. Joly; and, J.C. Vedrine, "$ZrO_2/SO_4^2$ Catalysts, Nature and Stability of Acid Sites Responsible for n–Butane Isomerization,"Proceedings of the 10th International Congress on Catalysis, Jul. 19–24, 1992, Budapest, Hungary.

Lignin
(wet)

Stage I (a) Mild BCD at 240-270 °C
(b) Selective hydrocracking (HT) with solid superacid catalysts, e.g., $Pt/SO_4^{2-}/ZrO_2$ or $Pt/WO_4^{2-}/ZrO_2$ at 340-375 °C

High O-content depolymerized lignin
(mixture of alkylated phenols and alkoxyphenols plus some alkylbenzenes and branched paraffins)

Stage II

Etherification (ETR) with MeOH (or EtOH)
Temperature, °C: 225-275
Catalysts: $WO_4^{2-}/ZrO_2$, $SO_4^{2-}/ZrO_2$ $SO_4^{2-}/MnO_x/Al_2O_3$, and other solid superacids

Reformulated, partially oxygenated gasoline
(substituted phenyl methyl and cycloalkyl methyl ethers, $C_7$ - $C_{10}$ alkylbenzenes, $C_6$ - $C_{10}$ multibranched paraffins, and polyalkylated cycloalkanes)

Fig. 1

PROCESS FOR CONVERSION OF LIGNIN TO REFORMULATED, PARTIALLY OXYGENATED GASOLINE

This application claims the benefit of priority to U.S. Provisional Application No. 60/097,701, filed on Aug. 21, 1998, the disclosure of which is herein incorporated by reference.

The U.S. Government has a paid-up license in this invention and the right in limited circumstances to require the patent owner to license others on reasonable terms as provided for by the terms of Grant No. XAC-5-14411-01 awarded by the National Renewable Energy Lab and Grant No. AU-8876 and Amendment 1 awarded by Sandia National Labs (DOE Flowthru).

BACKGROUND OF THE INVENTION

1. The Field of the Invention

The present invention is related generally to processes for converting biomass to gasoline products. More specifically, the present invention is related to a catalytic process for production of reformulated, partially oxygenated gasoline from lignin.

2. The Relevant Technology

The growing pollution problems in the United States and around the world are associated to a significant extent with undesirable side reactions during combustion of currently used fuels including gasolines and jet fuels. Conventional gasoline products were characterized in the past by a major proportion of aromatic hydrocarbon components, which, upon combustion, yield unacceptably large amounts of carbon monoxide and health-endangering levels of polycyclic carcinogens. The need for reformulation of gasoline, i.e., a significant change in the chemical composition of gasoline, has been recognized through a 1990 amendment of the Clean Air Act, which requires a lowering in the total aromatic content of gasoline to a maximum of 25 weight percent (wt-%), and a lowering in the concentration of a particular, strongly carcinogenic component, benzene, down to a level of less than 1 wt-%. Furthermore, the same amendment requires that the oxygen content of reformulated gasoline should be 2 wt-% or greater.

Reformulated gasoline compositions having somewhat lower concentrations of aromatic components and appropriate concentrations of oxygen-containing components, which are cleaner burning and markedly more environment-friendly than conventional current gasolines, are thus needed in order to comply with the Clean Air Act.

Prior processes concerned with petroleum-based reformulated gasoline compositions use several well-defined types of chemical reactions, including (a) alkylation of $C_3$ to $C_5$ olefins with branched $C_4$ and $C_5$ paraffins to produce higher branched paraffins in the gasoline boiling range; (b) skeletal isomerization of normal $C_4$ and $C_5$ olefins to produce branched $C_4$ and $C_5$ olefins, i.e., olefins containing tertiary carbons, which are needed for subsequent use in the production of appropriate ethers as additives for reformulated gasolines; (c) ring hydrogenation of aromatic hydrocarbons to reduce the aromatic content of naphthas and gasoline blends; (d) skeletal isomerization of normal paraffins to produce branched paraffins in the gasoline boiling range; and (e) etherification reactions of branched olefins to produce alkyl t-alkyl ethers, e.g., methyl t-butyl ether, ethyl t-butyl ether; methyl t-pentyl ether, and others, which are useful as oxygenated components of reformulated gasolines. In some of the below described patents there is either coordination or sequential application of two or more of the above types of reactions to produce desirable components for reformulated gasolines.

For example, a low severity continuous reforming process for naphthas that operates at conditions resulting in low coke formation and producing an improved reformulated gasoline is disclosed in U.S. Pat. No. 5,382,350 to Schmidt. The conditions for this reforming process include high space velocity, relatively high temperature, and low hydrogen to hydrocarbon ratios. The lower severity operation and a high hydrogen yield in this reforming process facilitate the removal of benzene from the reformulated gasoline pool, while diminishing the anticipated hydrogen deficit that reforming could cause. In U.S. Pat. No. 5,196,626 to Child et al., an isoparaffin/olefin alkylation process and reaction system is disclosed in which the liquid acid catalyst inventory is reduced and temperature control is improved by reacting the isoparaffin/olefin feed mixture with a thin film of liquid acid catalyst supported on a heat exchange surface.

A process for the depolymerization and liquefaction of coal to produce a hydrocarbon oil is disclosed in U.S. Pat. No. 4,728,418 to Shabtai et al. The process utilizes a metal chloride catalyst which is intercalated in finely crushed coal and the coal is partially depolymerized under mild hydrotreating conditions during a first processing step. The product from the first step is then subjected to base-catalyzed depolymerization with an alcoholic solution of an alkali hydroxide in a second processing step, and the resulting, fully depolymerized coal is finally hydroprocessed with a sulfided cobalt molybdenum catalyst in a third processing step to obtain a light hydrocarbon oil as the final product.

The above patents relate to processes for production of reformulated hydrocarbon gasoline compositions or light hydrocarbon oils using petroleum-derived streams or fractions or coal as feeds which are nonrenewable sources of energy. Renewable sources such as biomass or its components have been extensively examined as an alternative source for fuels, and in particular oxygenated fuels, e.g., ethanol and various ethers.

For example, U.S. Pat. No. 5,504,259 to Diebold et al. discloses a high temperature (450–550° C.) process for conversion of biomass and refuse derived fuel as feeds into ethers, alcohols, or a mixture thereof. The process comprises pyrolysis of the dried feed in a vortex reactor, catalytically cracking the vapors resulting from the pyrolysis, condensing any aromatic byproduct fraction followed by alkylation of any undesirable benzene present in the fraction, catalytically oligomerizing any ethylene and propylene into higher olefins, isomerizing the olefins to branched olefins, and catalytically reacting the branched olefins with an alcohol to form an alkyl t-alkyl ether suitable as a blending component for reformulated gasoline. Alternatively, the branched olefins can be hydrated with water to produce branched alcohols. Although the final alkyl t-alkyl etheric products of the above process are of value as blending components for reformulated gasoline, the anticipated low selectivity of the initial high-temperature pyrolysis stage of the process and the complexity of the subsequent series of treatments of intermediate products may limit the overall usefulness of the process.

A series of treatments of plant biomass resulting in the production of ethanol, lignin, and other products is disclosed in U.S. Pat. No. 5,735,916 to Lucas et al. Sugars are fermented to ethanol using an existing closed-loop fermentation system which employs genetically engineered thermophilic bacteria. The two desirable products of this process, i.e., lignin and ethanol, are mixed to produce a high energy fuel. In U.S. Pat. No. 5,478,366 to Teo et al., the preparation of a pumpable slurry is disclosed for recovering fuel value from lignin by mixing lignin with water, fuel oil and a dispersing agent, the slurry being defined as a pourable, thixotropic or near Newtonian slurry containing 35–60 wt-% of lignin and suitable for use as a liquid fuel.

A process for chemically converting polyhydric alcohols into a mixture of hydrocarbons and halogen-substituted hydrocarbons is disclosed in U.S. Pat. No. 5,516,960 to Robinson. Also disclosed is a process for conversion of cellulose or hemicellulose to hydrocarbon products of possible value as fuels.

Although the above described patents indicate that biomass or its components can be converted into fuel products, there is no disclosure as to selective conversion of lignin into gasoline, and in particular reformulated partially oxygenated gasoline. Accordingly, a selective process for high-yield conversion of biomass or important biomass components such as lignin into reformulated gasoline and reformulated gasoline blending components is highly desirable.

SUMMARY AND OBJECTS OF THE INVENTION

It is a primary object of the present invention to provide a process for producing reformulated gasoline compositions having high fuel efficiencies and clean, non-polluting combustion properties.

It is another object of the present invention to provide a process for producing superior quality reformulated gasoline compositions which are reliable and cost-efficient.

It is a further object of the present invention to provide a method for producing such superior quality reformulated gasoline compositions from a feed source that is a renewable, abundant, and inexpensive material such as biomass or its components.

To achieve the foregoing objects, and in accordance with the invention as embodied and described herein, a two-stage catalytic process is provided for conversion of inexpensive and abundant lignin feed materials to high-quality reformulated gasoline compositions in high yields. In the first stage of the process of the invention, a lignin feed material is subjected to a base-catalyzed depolymerization (BCD) reaction, followed by a selective hydrocracking (HT) reaction which utilizes a superacid catalyst. This produces a high oxygen-content depolymerized lignin product, which contains a mixture of compounds such as alkylated phenols, alkylated alkoxyphenols, alkylbenzenes, and branched paraffins. In the second stage of the process, the depolymerized lignin product is subjected to an etherification (ETR) reaction, which can be optionally followed by a partial ring hydrogenation (HYD) reaction, to produce a reformulated, partially oxygenated/etherified gasoline product. This gasoline product includes a mixture of compounds such as substituted phenyl/methyl ethers, cycloalkyl methyl ethers, $C_7$–$C_{10}$ alkylbenzenes, $C_6$–$C_{10}$ branched and multibranched paraffins, and alkylated and polyalkylated cycloalkanes.

The process of the invention has the advantage of being a high-yield catalytic reaction process that produces a reformulated, partially oxygenated gasoline product with a permissible aromatic content, i.e., about 25 wt-% or less, or if desired, with no aromatics.

These and other features, objects and advantages of the present invention will become more fully apparent from the following description, or may be learned by the practice of the invention as set forth hereinafter.

BRIEF DESCRIPTION OF THE DRAWINGS

In order to more fully understand the manner in which the above-recited and other advantages and objects of the invention are achieved, a more particular description of the invention briefly described above will be rendered by reference to a specific embodiment thereof illustrated in the appended drawings. Understanding that these drawings depict only a typical embodiment of the invention and are not therefore to be considered limiting of its scope, the invention will be described and explained with additional specificity and detail through the use of the accompanying drawings in which:

FIG. 1 is a schematic process flow diagram of the two-stage process for converting lignin to a reformulated, partially oxygenated gasoline according to the present invention;

DETAILED DESCRIPTION OF THE INVENTION

Figure 2:
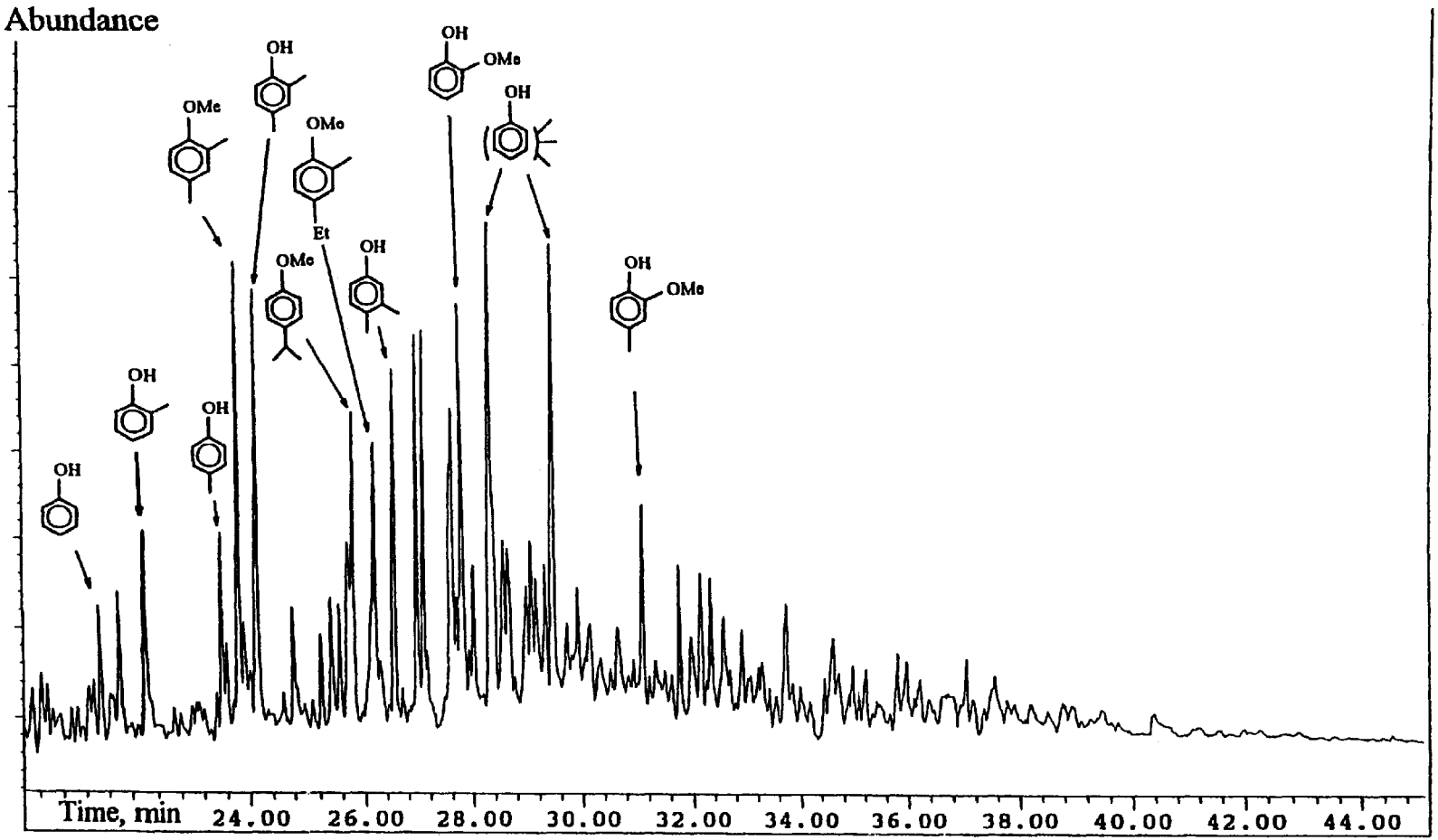
FIG. 2 is a graph showing the results of GC/MS analysis of a vacuum distilled product obtained by BCD-HT treatment of Kraft lignin.

The present invention is directed to a two-stage process for conversion of inexpensive and abundant biomass such as lignin feed materials to high-quality reformulated gasoline compositions in high yields. The process of the invention is a high-yield catalytic reaction process for production of a reformulated, partially oxygenated gasoline product such as a partially etherified gasoline with a controlled amount of aromatics.

In the first stage of the process of the invention, as indicated in FIG. 1 and as discussed in further detail below, a lignin material is subjected to a base-catalyzed depolymerization (BCD) reaction, followed by a selective hydrocracking (HT) reaction to thereby produce a high oxygen-content depolymerized lignin product, which contains a mixture of compounds such as alkylated phenols, alkylated alkoxyphenols, alkylbenzenes, branched paraffins, and the like. In the second stage of the process, the depolymerized lignin product is subjected to an exhaustive etherification (ETR) reaction, which is optionally followed by a partial ring hydrogenation (HYD) reaction, to produce a reformulated, partially etheric gasoline product, which includes a mixture of compounds such as substituted phenyl/methyl ethers, cycloalkyl methyl ethers, $C_7$–$C_{10}$ alkylbenzenes, $C_6$–$C_{10}$ branched and multibranched paraffins, and alkylated and polyalkylated cycloalkanes, and the like.

The process of the invention provides the basis for a technology aimed at production of a reformulated, partially oxygenated gasoline composed of an appropriately balanced mixture of highly efficient and desirable etherified compounds and desirable hydrocarbon compounds, with the mixture having a well controlled and permissible concentration of aromatics (e.g., up to about 25 wt-%).

Another important consideration in the development of the process of this invention is the nature of the feed. Whereas petroleum is expected to continue to play a predominant role in providing gasoline-range products in the near future, some alternative sources, in particular renewable biomass, are expected to play a gradually increasing role as feeds for liquid fuels. Biomass, which is a continuously renewable, abundant, and inexpensive feed source, and, on the other hand, a reliable and cost-effective production process, are both needed to ensure that biomass-based reformulated gasoline compositions can be produced and supplied in large quantities and at competitive prices.

A preferred biomass for use as the feed source in the process of the invention is lignin. Lignin is the most abundant natural aromatic organic polymer and is found extensively in all vascular plants. Thus, lignin is a major component of biomass, providing an abundant and renewable energy source. The lignin materials used as feeds for the process of the invention are readily available from a variety of sources such as the paper industry, agricultural products and wastes, municipal wastes, and other sources.

The production of the reformulated gasoline compositions of the present invention can involve the use of several, preferably coordinated chemical modifications, i.e., (1) control of the aromatic content at a permissible level of up to about 25 wt-% and practical exclusion of benzene as a component of the aromatic hydrocarbons fraction; and (2) formation of highly desirable oxygenated components, e.g., cycloalkyl methyl ethers and aryl methyl ethers.

The main features of the two-stage process of the invention for conversion of lignin into reformulated oxygenated gasoline are shown in the schematic process flow diagram of FIG. 1. The process as shown in FIG. 1 will be discussed in further detail as follows.

1. Stage I—BCD Reaction

In the first stage of the process of this invention, a lignin material that is preferably wet, is supplied from a feed source and is subjected to a low temperature, mild base-catalyzed depolymerization (BCD) reaction in a flow reactor. The BCD reaction uses a catalyst-solvent system comprising a base such as an alkali hydroxide, and a supercritical alcohol such as methanol, ethanol, or the like as a reaction medium/solvent. The lignin material can contain water already or can be mixed with water prior to usage in the process of the invention. The water can be present in an amount from about 10 wt-% to about 200 wt-%, and preferably from about 50 wt-% to about 200 wt-% with respect to the weight of the lignin material.

It is an advantage of the process of this invention that the reaction medium may contain water, however, there must be a sufficient amount of alcohol such as methanol or ethanol to maintain the supercritical conditions of the BCD reaction. Such conditions are easily achieved at alcohol/lignin weight ratios in the range of about 10 to about 1. A preferred methanol/lignin weight-ratio is from about 7.5 to about 2, while a preferred ethanol/lignin weight-ratio is from about 5 to about 1. Water can be included in the reaction medium by using an aqueous lignin dispersion as feed, or water can be added during the BCD reaction.

Solutions of a strong base such as sodium hydroxide, potassium hydroxide, cesium hydroxide, calcium hydroxide, mixtures thereof, or the like can be utilized to form the catalyst system employed in the BCD reaction. The NaOH, KOH, CsOH, $Ca(OH)_2$, or other strong bases are combined with methanol or ethanol, or with alcohol-water mixtures, to form effective catalyst/solvent systems for the BCD reaction. The base catalyst is dissolved in methanol or ethanol in a concentration from about 2 wt-% to about 10 wt-%. Solutions of NaOH are preferable depolymerizing catalyst agents, with the NaOH solutions exhibiting very high BCD activity and selectivity. The concentration of NaOH in methanol or ethanol, or in mixtures of these alcohols with water, is usually moderate, preferably in the range of about 2 wt-% to about 7.5 wt-%. It is an important feature of the process of this invention that the unreacted alcohol is recoverable during or after the BCD reaction.

Alternatively, a solid superbase catalyst can be utilized in the BCD reaction. Such alcohol-insoluble catalysts include high-temperature treated MgO, MgO—$Na_2O$, CsX-type zeolite, or combinations thereof. Preferably, the solid superbase catalyst has a Hammett function value (H_) of greater than about 26. The superbase catalysts in combination with methanol or ethanol, or with alcohol-water mixtures, form effective catalyst/solvent systems for the BCD reaction.

The BCD reaction can be carried out at a temperature in the range from about 230° C. to about 330° C., and preferably from about 240° C. to about 270° C. The reaction time can range from about 30 seconds to about 15 minutes. The pressure during the BCD reaction is in a range from about 1600 psig to about 2500 psig in an autoclave reactor, and less than about 2,000 psig in a continuous flow reactor system. The methanol or ethanol solvent/medium under supercritical conditions is a supercritical fluid exhibiting properties between those of a liquid and a gas phase.

The lignin feed used in the process of this invention can practically include any type of lignin material independent of its source or method of production. Suitable lignin materials include Kraft lignins which are a by-product of the paper industry, organosolve lignins, lignins derived as a byproduct of ethanol production processes, lignins derived from waste, including municipal waste, lignins derived from wood and agricultural products or waste, various combinations thereof, and the like.

Under suitable processing conditions, the BCD reaction proceeds with very high feed conversion (e.g., 95 wt-% or greater), yielding a mixture of depolymerized lignin products. Such BCD products include monomers and oligomers, including alkylated phenols, alkoxyphenols, alkoxybenzenes, and some hydrocarbons. The composition of the BCD lignin product, that is the relative yields of the depolymerized compounds, can be conveniently controlled by the BCD processing conditions, in particular by the reaction temperature, the reaction time, the alcohol/lignin weight ratio, the type of alcohol, the water/alcohol weight ratio, and the level of the autogenous pressure developed during the BCD process.

Table 1 below sets forth an example of a range of preferred processing conditions for the BCD process, including the use of NaOH and methanol, that can be utilized in the present invention.

TABLE 1

| Example of a Range of BCD Preferred Processing Conditions |
|---|
| 1. MeOH/lignin weight ratios in the range of about 1:1 to about 5:1. |
| 2. NaOH concentration in MeOH: about 2–7 wt-%. |
| 3. Water present in the MeOH medium in the range of 100–200 wt-%, corresponding to a water/lignin weight ratio in the range of about 2:1 to about 10:1. |
| 4. Maximum MeOH consumption - 0.5 mol per mol of monomeric lignin (M.W. ~166), corresponding to: 0.96 g MeOH/10 g lignin |
| 5. Reaction temperature: about 230–290° C. |
| 6. Reaction time: about 2–5 min[a] |

[a]Shorter residence time per pass, for example, about 0.5–2 min, is applicable in flow reactor systems.

Table 2 below sets forth another example of preferred BCD processing conditions, including the use of a solid superbase catalyst, that can be utilized in the present invention.

TABLE 2

| Example of BCD Processing Conditions Using a Solid Superbase Catalyst[a] |
|---|
| 1. Solid superbase catalyst: high-temperature treated MgO, or MgO—$Na_2O$ (alcohol-insoluble). |
| 2. MeOH/lignin wt-ratios in the range of about 1:1 to 5:1. |
| 3. Water present in the MeOH medium in the range of about 100–200 wt-%, corresponding to a water/lignin weight ratio in the range of about 2:1 to about 10:1 |
| 4. Reaction temperature, about 230–330° C.; reaction time: about 2–5 min[b]. |
| 5. Acid consumption - none (no acidification of the BCD product needed). |

[a]Mainly in a flow reactor system.
[b]Shorter reaction time per pass, for example about 0.5 to 2 min, is applicable in flow reactor systems.

2. Stage I—HT Reaction

The BCD products formed during the BCD reaction step are subsequently subjected to a hydrotreatment process in the form of a selective C—C hydrocracking (HT) reaction to thereby produce a high oxygen-content depolymerized lignin product. The HT reaction is a very efficient procedure for conversion of O-containing oligomeric components (of the BCD products) into monomeric/monocluster products, with preservation of the O-containing functional groups. The procedure involves selective hydrocracking of oligomeric components in the presence of a Pt-modified superacid catalyst as indicated for example in the reaction sequence below:

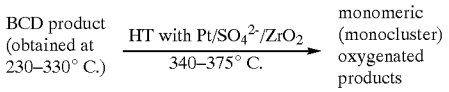

The conversion level in the above HT reaction and the O-content of the depolymerized products can be controlled as a function of temperature, time, catalyst acidity and catalyst/feed ratio. The HT reaction provides for selective cleavage of C—C bonds in the oligomeric components by selective acid-catalyzed hydrogenolysis of intercluster C—C bonds, without a significant extent of competing removal of O-containing functional groups.

As indicated above, the HT procedure involves the use of a Pt-modified superacid catalyst, which can be supported or nonsupported, such as sulfated zirconia ($Pt/SO_4^{2-}/ZrO_2$). The selectivity of the $Pt/SO_4^{2-}/ZrO_2$ catalyst is based on its stronger activity for hydrogenolytic cleavage of (Ar)C—C (al)bonds, viz., intercluster C—C bonds, as compared with that for hydrogenolytic cleavage of (Ar)C—O bonds. Examples of other Pt modified superacid catalysts that are highly effective and can be used in the HT reaction besides sulfated zirconia include tungstated zirconia ($Pt/WO_4^{2-}/ZrO_2$), sulfated titania ($Pt/SO_4^{2-}/TiO_2$), combinations thereof and the like.

An example of a suitable procedure for carrying out the HT reaction follows. The BCD product (feed) is transferred directly to an autoclave, or, for convenience, by first dissolving it in a small amount of ether. The autoclave is warmed up to about 35° C., the ether is removed by passing a stream of $N_2$, and about 20% by weight of $Pt/SO_4^{2-}/ZrO_2$ is then added to the solvent-free feed. The autoclave is then purged sequentially with $N_2$ and $H_2$ and finally charged with $H_2$ to the desired level, e.g., about 1500 psig. The autoclave is brought to the selected temperature, e.g., about 350° C., with slow mixing (e.g., 100 rpm), and then kept for the desired length of time, e.g., about 1–2 hours, with constant stirring (e.g., 500 rpm). Any small amount of gas product is collected in a liquid nitrogen trap. At the end of the run, the liquid product plus catalyst are removed from the autoclave and then subjected to centrifugation to separate the product from the catalyst plus a small amount of water (the latter being derived from a small extent of competing hydrodeoxygenation of the feed during the reaction). In a typical run at 350° C., the product distribution was as follows, in wt-%: liquids, 86.6; water, 6.4; gas, 7.0.

The results of analysis on the O-content of the liquid product obtained by the above procedure (as compared with that of the feed) indicate that at least 90% of the O-containing functional groups, initially present in the feed, are preserved in the product during the selective hydrocracking reaction. Prominently absent in the product mixture is benzene, which is an undesirable carcinogenic compound, usually present in aromatic hydrocarbon fractions. While trace amounts of benzene can be present (e.g., less than about 0.2 wt-%), the substantial absence of benzene is due to the absence of nonsubstituted aromatic rings in the lignin structural network.

3. Stage II—ETR and HYD Reactions

In the second stage of the process of this invention, the depolymerized lignin product is subjected to an exhaustive etherification (ETR) reaction, which can be optionally followed by a partial ring hydrogenation (HYD) reaction, to produce a reformulated, partially oxygenated/etherified gasoline product.

In the exhaustive etherification reaction, the phenolic groups in the BCD products are reacted at an elevated temperature and pressure with an alcohol such as methanol or ethanol, in the presence of a solid superacid catalyst. The temperature can range from about 100–400° C., preferably from about 225–275° C., and the pressure can be from about 100 psig to about 2000 psig. Suitable catalysts include supported or nonsupported sulfated or tungstated oxides of metals such as Zr, W, Mn, Cr, Mo, Cu, Ag, Au, and the like, and combined catalyst systems thereof. For example, catalysts found to be highly effective in the etherification reaction include unsupported $SO_4^{2-}/ZrO_2$ and $WO_4^{2-}/ZrO_2$ systems. Also effective as catalysts are some reported $Al_2O_3$-supported catalysts of this type, for example, $SO_4^{2-}/MnO_x/Al_2O_3$ and $SO_4^{2-}/WO_x/Al_2O_3$, as disclosed in U.S. Pat. Nos. 4,611,084, 4,638,098, and 4,675,456 to Mossman, which are incorporated herein by reference.

It is a novel feature of the process of this invention that any partially etherified product is subjected to thorough drying before recyclization in the reactor. In a flow reactor system, having a solid superacid catalyst fixed-bed tubular reactor, this is accomplished by passing the recycled product through a drying column prior to readmission to the reactor. Various materials, in particular anhydrous $MgSO_4$, can be used as effective drying agents. The continuous removal of water from the recycled product during the process, displaces the equilibrium of the reaction in the direction of essentially complete (≧90%) etherification of the phenolic groups in the BCD-HT feed.

An important consideration for Stage II of the process of the invention is that, due to the high O-content of BCD-HT products (about 13–14 wt-%), viz., the presence of 1–2 methoxy groups per oxygenated component molecule, the beneficial combustion effect of etheric oxygens present in the main product compounds could outweigh the environmentally "negative" effect of the aromatic rings in these compounds. Consequently, only limited ring hydrogenation, if any, may be necessary for producing the final gasoline product.

In an optional additional step, an etherified product of the etherification reaction can be subjected to a partial ring hydrogenation (HYD) reaction to produce a reformulated partially oxygenated gasoline product with reduced aromatic content. The HYD reaction can be carried out at a temperature from about 50° C. to about 250° C. under a $H_2$ pressure of about 500–2500 psig in the presence of a catalyst. Examples of suitable catalysts for the HYD reaction include $Pt/Al_2O_3$, $Pd/Al_2O_3$, Pt/C, Pd/C, combinations thereof, and the like.

By proper selection of a catalyst of moderate ring hydrogenation activity and relatively short reaction time, the extent of ring hydrogenation can be moderated and controlled to obtain a final, partially oxygenated gasoline product containing the permissible concentration of total aromatics, such as alkylbenzenes and aromatic ethers, of about 25 wt-% or less, and a substantially zero concentration of benzene.

The reformulated gasoline compositions produced according to the present invention demonstrate greatly superior properties when compared to current commercial gasoline compositions. In particular, the reformulated gasoline compositions of the invention exhibit desirable high fuel efficiencies, as well as clean-burning and non-polluting combustion properties. The reformulated gasoline compositions are also reliable and cost-efficient to produce. Further, the process of the invention produces superior quality reformulated gasoline compositions from a biomass feed source or its components that is renewable, abundant and inexpensive.

EXAMPLES

The experimental procedures applied as well as the yield and composition of products obtained under various processing conditions are set forth in the following non-limiting examples, which illustrate the lignin-to-oxygenated gasoline (LTOG) process of the invention.

Example 1

An example of runs on sequential BCD-HT treatment of a Kraft (Indulin) lignin is given in Table 3. A BCD product was first obtained at a temperature of 270° C., using a 7.0 wt-% solution of sodium hydroxide in methanol as a depolymerizing agent. The BCD product was then subjected to an HT reaction under the indicated conditions, resulting in a product which was subjected to vacuum distillation to separate the monocyclic phenolic components from higher boiling oligomers. The distillation data show that under the mild HT conditions used (temperature, 350° C.; $H_2$ pressure, 1500 psig) about 30.7 wt-% of oligomers persist in the product. A gas chromatographic/mass spectral (GC/MS) analysis of the main liquid product (fraction 2) shows that the liquid includes a mixture of alkylated phenols and alkoxyphenols such as mono-, di-, and trimethylsubstituted phenols, accompanied by methylated methoxyphenols and catechols, and some alkylated benzenes and branched paraffins, as indicated in FIG. 2. FIG. 2 is a graph showing the results of the GC/MS analysis of the vacuum distilled product obtained by BCD-HT treatment of the Kraft lignin. The unmarked peaks in the graph of FIG. 2 include additional phenols, alkylbenzenes, and branched paraffins.

Under higher $H_2$ pressure (e.g., 1800 psig) and reaction temperature (e.g., 365° C.), and in the presence of a higher concentration of superacid catalyst, essentially complete depolymerization (i.e., less than about 8 wt-% of residual oligomers) is observed.

TABLE 3

| Example of a BCD-HT Run | |
|---|---|
| 1. | BCD step: 270° C.; 7 wt-% NaOH in MeOH; feed, Kraft lignin (Indulin AT); total yield of BCD product, 93.5 wt-%. |
| 2. | HT step:<br>Feed: 10.0 g of BCD product (from BCD step)<br>Catalyst: 2.0 g of $Pt/SO_4^{2-}/ZrO_2$<br>Reaction conditions:<br>temperature 350° C.<br>$H_2$ pressure: 1500 psig<br>reaction time: 2 hours |

This preparation was repeated 3 times, and 24.0 g of the collected BCD-HT product (dark liquid) were subjected to vacuum distillation (a small fraction of low boiling products was first collected at atmospheric pressure).

Distillation data:

| | b.p. ° C./pressure | amount. g | wt-% |
|---|---|---|---|
| Fraction 1 | 35–65/760 torr | 0.96 | 4.2 |
| Fraction 2 | 62–115/0.1 torr | 14.94 | 65.1 |
| Residue (oligomers) | >115/0.1 torr | 7.05 | 30.7 |
| total | | 22.95 | 100.0 |
| recovery | | 95.6% | |

Example 2

Table 4 below summarizes results obtained in a series of BCD-HT runs in which the MeOH/lignin weight ratio (in the BCD step) was gradually decreased from 10.0 to 3.0. The GC/MS analysis of the BCD-HT products shows that with decrease in the MeOH/lignin ratio (in the BCD step), the concentration of highly desirable mono- and dimethylsubstituted phenols (plus methoxyphenols) gradually increases, whereas that of trisubstituted (and some tetrasubstituted) phenols correspondingly decreases. It was found that at even lower MeOH/lignin ratios (e.g., 2.0) and in the presence of large amounts of water, selective formation of desirable mono- and dimethylated phenols can be achieved, with the essential exclusion of any more highly alkylated phenols. This is of major importance for optimization of the LTOG process, since it is desirable that the boiling points of the final etherified products be within the gasoline boiling range.

TABLE 4

Analysis of BCD-HT Products Obtained from Kraft (Indulin AT) Lignin using Different MeOH/Feed Weight Ratios in the BCD Step[a,b]

| Run No. | Methanol/ lignin ratio in the BCD step | Content of monomeric compounds in the BCD-HT product, wt %[c] | Distribution of BCD-HT monomeric products, wt %[d] | | | |
|---|---|---|---|---|---|---|
| | | | $C_5$–$C_{11}$ hydrocarbons | $C_1$–$C_2$ alkyl-substituted phenols and methoxyphenols[e] | $C_3$–$C_4$ alkyl-substituted phenols[f] | Higher O-containing compounds and $>C_{12}$ hydrocarbons |
| 1 | 10.0 | 72.0 | 12.7 | 56.9 | 25.0 | 5.4 |
| 2 | 7.5 | 70.6 | 12.5 | 67.5 | 14.3 | 5.7 |
| 3 | 5.0 | 70.3 | 12.5 | 71.3 | 10.8 | 5.4 |
| 4 | 3.0 | 71.4 | 11.9 | 80.4 | 5.2 | 2.0 |

[a]In each BCD run was used 10.0 g of lignin feed and 7.1 g of NaOH dissolved in the calculated amount of MeOH; reaction temperature, 270° C.; reaction time, 5.0 min; reactor, 300 cc autoclave.
[b]In each HT run were used the BCD product from the preceding step as feed and $Pt/SO_4^{2-}/ZrO_2$ as catalyst (feed/catalyst wt ratio, 5:1); $H_2$ pressure, 1500 psig; reaction temperature, 350° C.; reaction time, 2 h, reactor, 50.0 cc Microclave.
[c]Results obtained by simulated distillation.
[d]Obtained from GC/MS integration data.
[e]$C_1$-alkyl indicates methylphenols or methoxyphenol; $C_2$-alkyl predominantly indicates dimethylphenols or methylmethoxyphenols.
[f]$C_3$-alkyl and $C_4$-alkyl indicates the total number of carbons in alkyl substituents.

Example 3

Following is an example of the etherification procedure used in Stage II of the process of the invention. A 5.0 g sample of a vacuum distilled BCD-HT product was subjected to etherification with 15.0 g of methanol and 2.0 g of a $WO_4^{2-}/ZrO_2$ catalyst in a 50 cc Microclave reactor under the following conditions: reaction temperature, 250° C.; reaction time, 2 hours; autogenic reaction pressure, 1200 psig; stirring rate, 500 r.p.m. The product was dried with anhydrous $MgSO_4$ and then subjected to repeated reaction for another 2 hours. By comparison, with a feed not etherified, it was determined that the extent of the etherification of phenolic compounds in the final etherified product was 91.2 wt-%.

Figure 3:
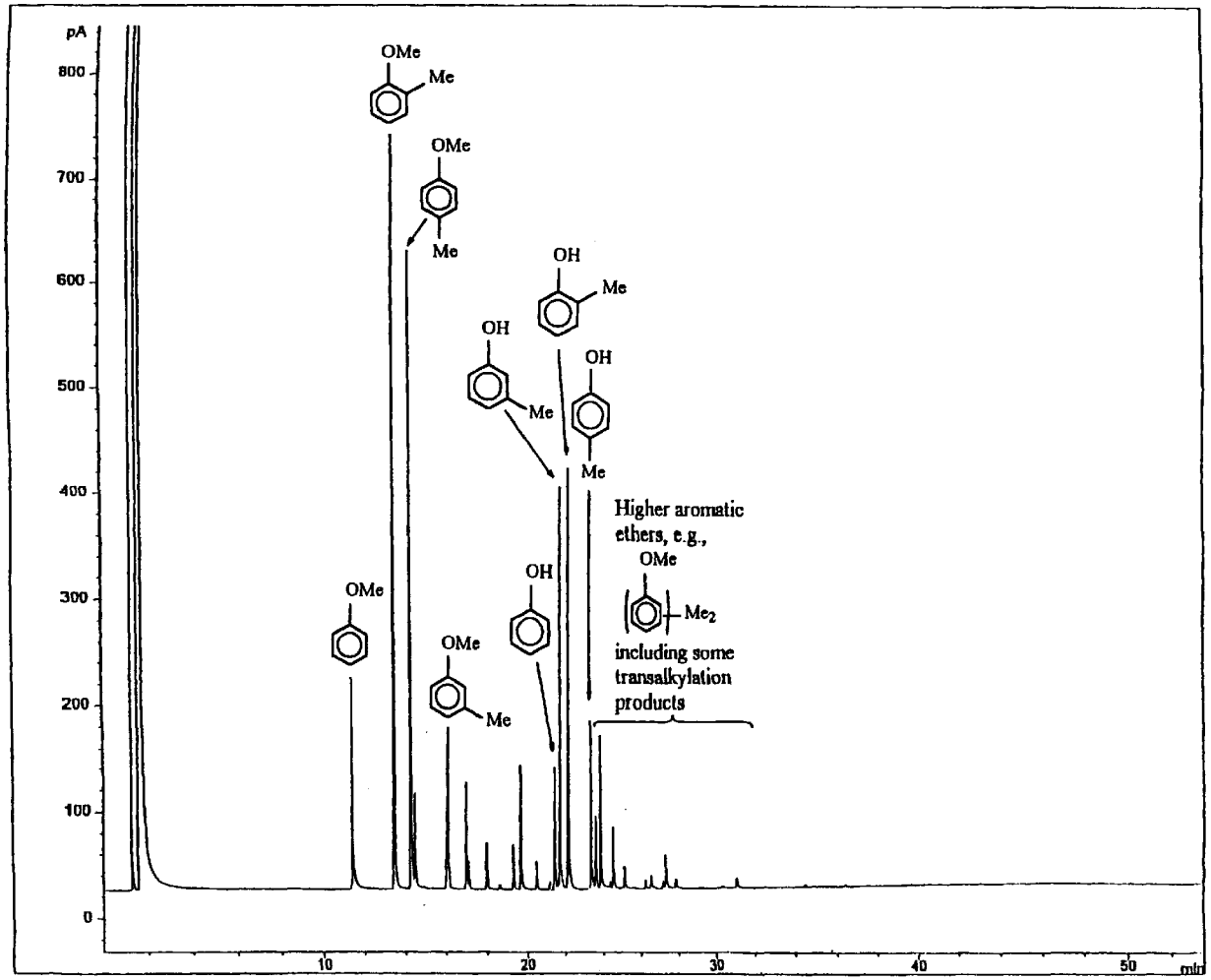
FIG. 3 is a graph showing the results of GC/MS analysis of a partially etherified product obtained from the phenol/methylphenol fraction of the BCD-HT product at an advanced stage of etherification with methanol.

FIG. 3 is a graph showing the results of GC/MS analysis of a partially etherified product obtained from the phenol/methylphenol distillable fraction of the BCD-HT product at an advanced stage of etherification (~80 wt-%) with methanol. The exhaustive etherification of the phenolic groups in the BCD products results in conversion of these groups into methoxy groups with a consequent major increase in the volatility of the final, partially oxygenated gasoline product.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A process for converting lignin into reformulated, partially oxygenated gasoline, comprising the steps of:

(a) providing a lignin material;

(b) subjecting the lignin material to a base-catalyzed depolymerization reaction in the presence of a supercritical alcohol, followed by a selective hydrocracking reaction in the presence of a superacid catalyst to produce a high oxygen-content depolymerized lignin product; and (c) subjecting the depolymerized lignin product to an etherification reaction to produce a reformulated, partially oxygenated/etherified gasoline product.

2. The process of claim 1, wherein the lignin material is selected from the group consisting of Kraft lignins, organosolve lignins, lignins derived from wood products or waste, lignins derived from agricultural products or waste, lignins derived from municipal waste, and combinations thereof.

3. The process of claim 1, wherein the lignin material includes water or is mixed with water in an amount from about 10 wt-% to about 200 wt-% with respect to the weight of the lignin material.

4. The process of claim 1, wherein the alcohol is methanol or ethanol.

5. The process of claim 1, wherein the depolymerization reaction utilizes a base catalyst selected from the group consisting of sodium hydroxide, potassium hydroxide, calcium hydroxide, cesium hydroxide, and mixtures thereof.

6. The process of claim 5, wherein the base catalyst is dissolved in methanol or ethanol in a concentration from about 2 wt-% to about 10 wt-%.

7. The process of claim 1, wherein the depolymerization reaction utilizes a solid superbase catalyst having a Hammett function value greater than about 26.

8. The process of claim 7, wherein the solid superbase catalyst is selected from the group consisting of high-temperature treated MgO, MgO—$Na_2O$, CsX-type zeolite, and combinations thereof.

9. The process of claim 1, wherein the depolymerization reaction is carried out at a temperature from about 230° C. to about 330° C.

10. The process of claim 1, wherein the depolymerization reaction time is from about 30 seconds to about 15 minutes.

11. The process of claim 4, wherein the methanol/lignin weight-ratio during the depolymerization reaction is from about 2 to about 7.5.

12. The process of claim 4, wherein the ethanol/lignin weight-ratio during the depolymerization reaction is from about 1 to about 5.

13. The process of claim 1, wherein the superacid catalyst is a platinum-modified catalyst.

14. The process of claim 13, wherein the superacid catalyst is selected from the group consisting of supported or nonsupported $Pt/SO_4^{2-}/ZrO_2$, $Pt/WO_4^{2-}/ZrO_2$, $Pt/SO_4^{2-}/TiO_2$, and combinations thereof.

15. The process of claim 1, wherein the depolymerized lignin product comprises a mixture of compounds belonging to the group consisting of alkylated phenols, alkylated alkoxyphenols, alkybenzenes, and branched paraffins.

16. The process of claim 1, wherein the etherification reaction includes reacting phenolic groups in the depolymerized lignin product at an elevated temperature and pressure with an alcohol in the presence of a superacid catalyst.

17. The process of claim 16, wherein the etherification reaction is carried out at a temperature from about 100° C. to about 400° C., and at a pressure from about 100 psig to about 2000 psig.

18. The process of claim 16, wherein the alcohol in the etherification reaction is methanol or ethanol.

19. The process of claim 16, wherein the catalyst in the etherification reaction is a sulfated or tungstated oxide of a metal selected from the group consisting of Zr, W, Mn, Cr, Mo, Cu, Ag, Au, and combinations thereof.

20. The process of claim 16, wherein the catalyst in the etherification reaction comprises a solid superacid selected from the group consisting of $SO_4^{2-}/ZrO_2$, $WO_4^{2-}/ZrO_2$, $SO_4^{2-}/MnO_x/Al_2O_3$, $SO_4^{2-}/WO_x/Al_2O_3$, and combinations thereof.

21. The process of claim 1, further comprising the step of subjecting a product of the etherification reaction to a partial ring hydrogenation reaction to produce a reformulated, partially oxygenated/etherified gasoline product.

22. The process of claim 21, wherein the hydrogenation reaction is performed at an elevated temperature and pressure in the presence of a catalyst.

23. The process of claim 22, wherein the hydrogenation reaction is carried out at a temperature from about 50° C. to about 250° C., and at a hydrogen pressure from about 500 psig to about 2500 psig.

24. The process of claim 22, wherein the catalyst in the hydrogenation reaction is selected from the group consisting of $Pt/Al_2O_3$, $Pd/Al_2O_3$, Pt/C, Pd/C, and combinations thereof.

25. The process of claim 21, wherein the hydrogenation reaction is moderated and controlled to produce a partially oxygenated/etherified gasoline product having a concentration of aromatics of about 25 wt-% or less.

26. The process of claim 1, wherein the partially oxygenated/etherified gasoline product comprises a mixture of compounds belonging to the group consisting of substituted phenyl/methyl ethers, cycloalkyl methyl ethers, $C_7$–$C_{10}$ alkylbenzenes, $C_6$–$C_{10}$ branched and multibranched paraffins, and alkylated and polyalkylated cycloalkanes.

* * * * *